US005772456A

United States Patent [19]

Ohishi

[11] Patent Number: 5,772,456

[45] Date of Patent: Jun. 30, 1998

[54] HOUSING STRUCTURE FOR ROTARY CONNECTORS

[75] Inventor: Hiroshi Ohishi, Tokyo, Japan

[73] Assignee: Niles Parts Co., Ltd., Japan

[21] Appl. No.: 609,384

[22] Filed: Mar. 1, 1996

[30] Foreign Application Priority Data

Mar. 28, 1995 [JP] Japan ..... 7-094499

[51] Int. Cl.[6] ..... H01R 35/04

[52] U.S. Cl. ..... 439/164; 439/15

[58] Field of Search ..... 439/164, 15

[56] References Cited

FOREIGN PATENT DOCUMENTS 4-54714 12/1992 Japan .

*Primary Examiner*—Gary F. Paumen

*Attorney, Agent, or Firm*—Ronald P. Kananen

[57] ABSTRACT

A housing structure for rotary connectors that have a flexible cable 4 spirally received within a space formed by a stator housing 1 and a rotor housing 2. Terminals 51 connected to electric conductors 42 of the flexible cable 4 are supported by a supporter 11 mounted in the stator housing 1. The supporter 11 has a barrier 13 having a path 12 through which the flexible cable 4 can be passed. An angle θ of an opening 12*a* positioned at an end position of the path 12 is larger than 180°. A gap width t1 of the path 12 is approximately equal to a thickness t2 of the flexible cable 4. The housing structure avoids a state wherein the conductors 42 of a disconnected flexible cable 4 are contacted again with the terminals 51, or wherein the disconnected sections of the adjacent terminals 51 are undesirably short-circuited by the conductors 42 of the disconnected flexible cable 4, in the case where the electrical connection between the conductors 42 of the flexible cable 4 and the terminals 51 is once disconnected.

4 Claims, 4 Drawing Sheets

HOUSING STRUCTURE FOR ROTARY CONNECTORS

BACKGROUND OF THE INVENTION

1. Field of the Invention

The present invention relates generally to electrical connector devices, and particularly, to an improvement in rotary connectors for supplying a power source current to electrical components, such as an air bag provided on a pad portion of a steering wheel of an automobile.

2. Description of the Prior Art

Recently, the techniques for protecting an occupant of an automobile from a shock when an automobile accident occurs by inflating an air bag have been put to practical use. In an air bag system, especially an air bag provided on a pad portion of a steering wheel, it is necessary that a power source current be supplied from a chassis of the vehicle to an inflator for the air bag on the pad portion via a rotary portion of the steering wheel. Conventional power source current supply means include mainly a means using a slip ring, or a means, such as a rotary connector, which uses a spirally wound flexible cable.

Various types of such rotary connectors have heretofore been proposed. For example, the rotary connector disclosed in Japanese Utility Model Publication No. 54714/1992 is provided with a stator housing, a rotor housing set rotatably with respect to the stator housing, and a flexible cable held spirally in a space formed by the two housings. It is further provided with a guide (circumferential wall) for guiding an end portion of the flexible cable into the space, and an attachment (pivotable ring) for connecting the stator housing and rotor housing together.

FIG. 4*a* is an electric circuit diagram showing a condition of the electric connection in a conventional rotary connector a of an air bag unit b, an inflator c, and a horn switch d, which are parts on the side of a steering wheel, and an air bag controller e and a horn f, which are parts on the side of a chassis. The exposed portions of conductive wires a2–a7 in a flexible cable a1 in the rotary connector a are connected to terminals a8–a13 by welding. FIG. 4*b* shows a supporter a14 provided in the rotary connector a, and the terminals a8–a13 connected to the conductive wires a2–a7 in the flexible cable a1 are supported on this supporter a14.

However, when a high tension is imparted to the flexible cable a1 in the rotary connector a, so that the conductive wires a2–a7 and terminals a8–a13 are disconnected, as shown in FIG. 4*b*, the flexible cable a1 temporarily leaves the supporter a14 due to the tension mentioned above. When the steering wheel of the automobile is then turned, for example, to left, a rotor housing (not shown) in the rotary connector a is also turned counter-clockwise, so that the flexible cable a1 is moved in the direction of an arrow F in FIG. 4*b* to enter the inside of the supporter a14 again. Consequently, the exposed portions of the conductive wires a2–a7 in the flexible cable a1 come into contact with the terminals a8–a13 again, but they are in an imperfectly connected condition.

Moreover, when the conductive wires a2–a7 come into contact with the terminals a8–a13 in a slightly laterally staggered positional relationship as shown in, for example, FIG. 4*a*, adjacent terminals a8–a13 are short-circuited via the conductive wires a2–a7. Therefore, an unintended circuit for operating the horn f in which the horn f, terminal a9, conductive wire a4, terminal a1O and air bag controller e are connected in the mentioned order is formed, as shown in, for example, FIG. 4*a*, and the horn f is erroneously actuated.

SUMMARY OF THE INVENTION

The present invention has been developed in view of the above-described problems with the prior art devices. Specifically, the present invention aims at preventing broken conductive wires in a flexible cable and terminals from contacting each other again when the conductive wires in the flexible cable and the terminals are disconnected from each other, and preventing the disconnected portions of adjacent terminals from being short-circuited due to the broken conductive wires in the flexible cable.

The present invention provides the following means for achieving these objects. First, the invention provides a housing structure for a rotary connector having a stator housing, a rotor housing provided rotatably with respect to the stator housing, and a flexible cable that is held spirally in a space formed by the two housings. The flexible cable is connected at one end thereof to the stator housing and at the other end thereof to the rotor housing. A conductive wire in the flexible cable is electrically connected to a terminal, the terminal being supported on a supporter provided on at least one of the two housings. The invention is characterized in that barriers for preventing the flexible cable, which has been broken and left the supporter from entering the inside of the supporter again, are provided on at least one of the two housings.

The housing structure according to the present invention is further characterized in that the barriers are provided on the supporter, and in that the barriers have a passage for passing the flexible cable therethrough. Moreover, a clearance forming the passage has a width t1 set substantially equal to a thickness t2 of the flexible cable. An angle θ of an inlet surface of the passage is preferably set larger than 180 degrees.

BRIEF DESCRIPTION OF THE DRAWINGS

The present invention will become more clearly appreciated as the disclosure of the present invention is made with reference to the accompanying drawings. In the drawings:

FIGS. 1*a* and 1*b* show a preferred embodiment of a rotary connector according to the present invention, wherein FIG. 1*a* is an enlarged view of a principal portion; and FIG. 1*b* is a sectional view taken along the arrow-carrying line B—B in FIG. 1*a* in the direction of the arrows.

FIGS. 2*a* and 2*b* are partially cutaway plan views of the rotary connector shown in FIG. 1, wherein FIG. 2*a* shows the condition in which tension is imparted to the flexible shaft; and FIG. 2*b* shows the condition in which a flexible cable is broken.

FIGS. 3*a*, 3*b*, and 3*c* are enlarged views of a portion A shown in FIG. 2*a*, wherein FIG. 3*a* shows the condition in which tension is imparted to the flexible cable; FIG. 3*b* shows the condition in which the flexible cable is broken; and FIG. 3*c* shows the condition in which the broken flexible cable contacts an inlet surface of a supporter.

FIGS. 4*a* and 4*b* illustrate a conventional rotary connector, wherein FIG. 4*a* is an electric circuit diagram; and FIG. 4*b* is a detail drawing of a principal portion.

DETAILED DESCRIPTION OF THE PREFERRED EMBODIMENT

Figure 1A:
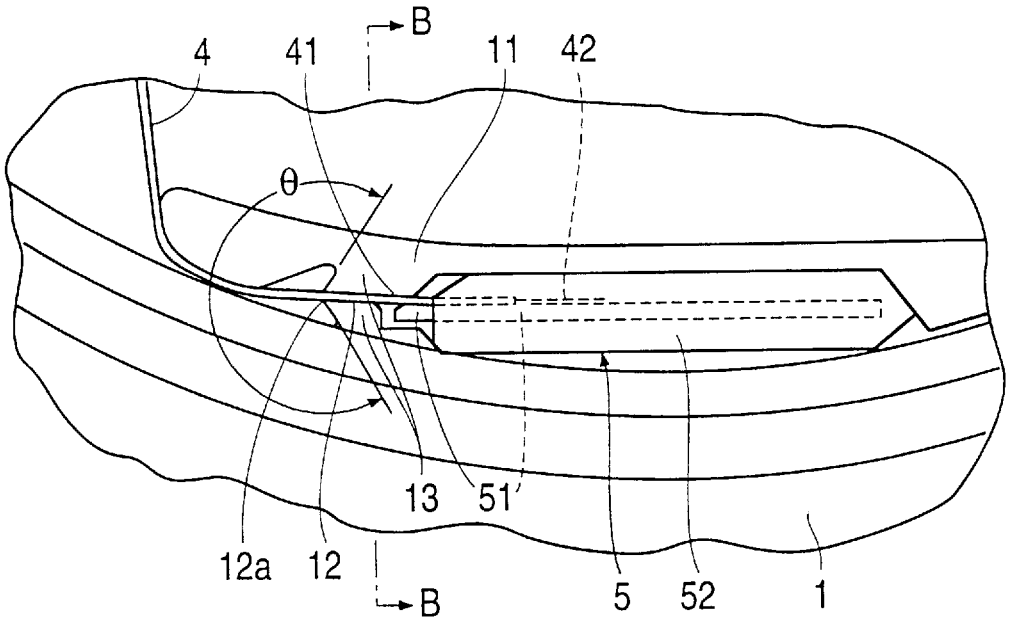

Preferred embodiments of the present invention will be described in detail hereinafter with reference to FIGS. 1 to 3.

Referring to the drawings, a reference numeral 1 denotes a stator housing, 2 a rotor housing, 3 an attachment, 4 a flexible cable, and 5 a molded body, all of which will now be described.

First of all, the stator housing 1 is a part to be fixed to a combination switch (not shown) of, for example, an automobile. The stator housing 1 is provided with a supporter 11 for supporting the molded body 5 along the circumferential wall thereof. The supporter 11 has barriers 13 for preventing the flexible cable 4, which has been broken and left the supporter 11, from entering the inside of the supporter 11 again. The barriers 13 are provided with a passage 12 for passing the flexible cable 4 therethrough.

The barriers 13 have an inlet surface 12*a* at a terminal portion of the passage 12. This inlet surface 12 is a surface of a part at which the flexible cable 4 is drawn out from the passage 12 toward a space defined by the two housings 1, 2. An angle θ made by the inlet surface is set larger than 180 degrees, for example, around 240 degrees. Therefore, when a broken flexible cable 4 has once come out of the inlet surface 12*a*, it becomes difficult for this cable to enter the passage 12 again via the inlet surface 12*a*. Accordingly, an erroneous operation of a load on a vehicle, which occurs when a sheath-removed portion of a conductive wire 42 in such a broken flexible cable 4 contacts the terminal 51 again, can be prevented.

A detailed description of this matter will now be given. For example, assume that the rotor housing 2 is turned clockwise, as shown by an arrow C in FIG. 2*a*, to cause a high tension to be imparted to the flexible cable 4, as shown by an arrow D in FIGS. 2*a* and 3*a*. The high tension in the flexible cable 4 causes the flexible cable 4 to be disconnected from the terminal 51. Since the flexible cable 4 has the property of returning to a straight extending state by its own resilient force, it is then unwound and brought into pressure contact with an outer wall of the stator housing 1, as shown in FIG. 2*b*.

Figure 2A:
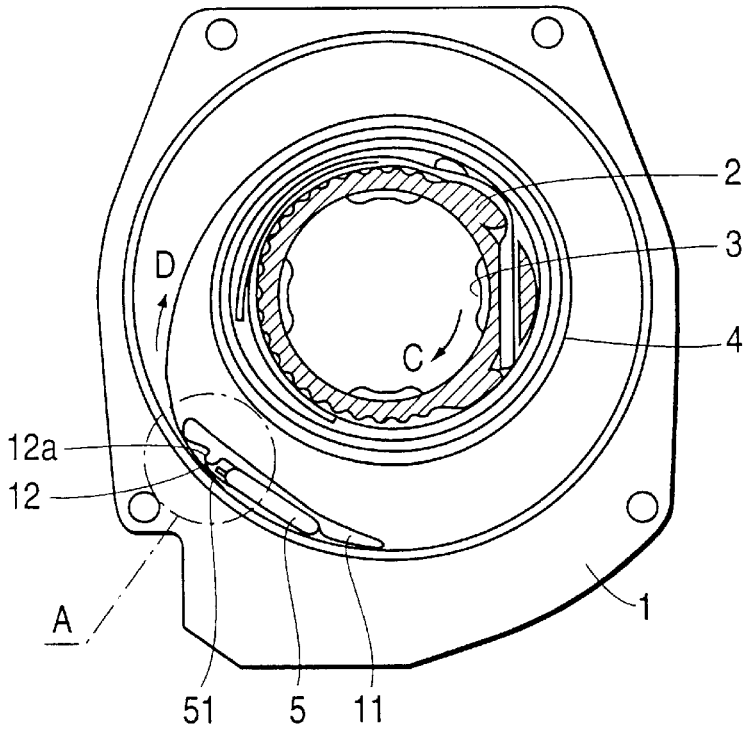
Figure 2B:
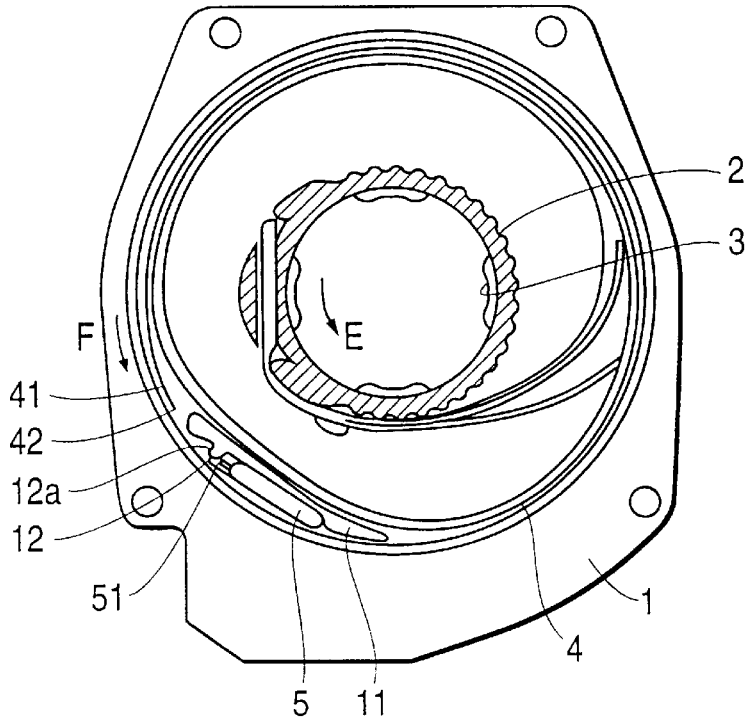
Figure 3A:
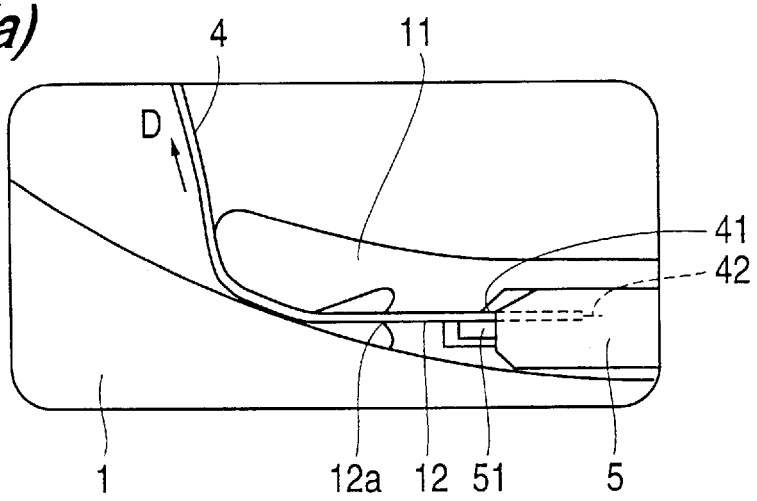
Figure 3B:
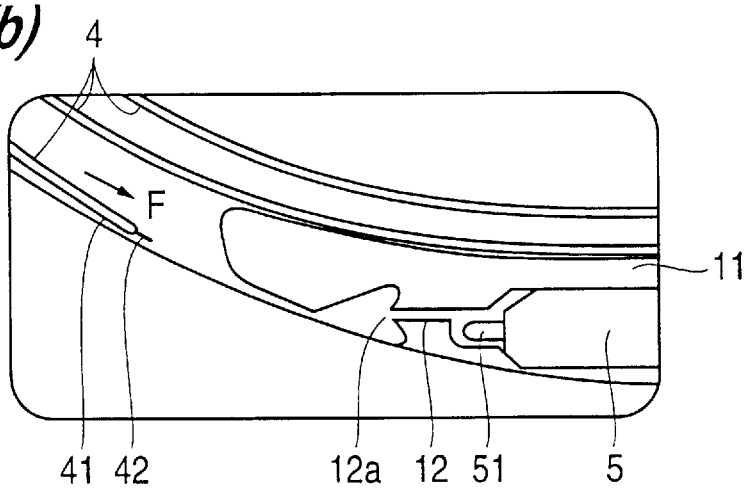
Figure 3C:
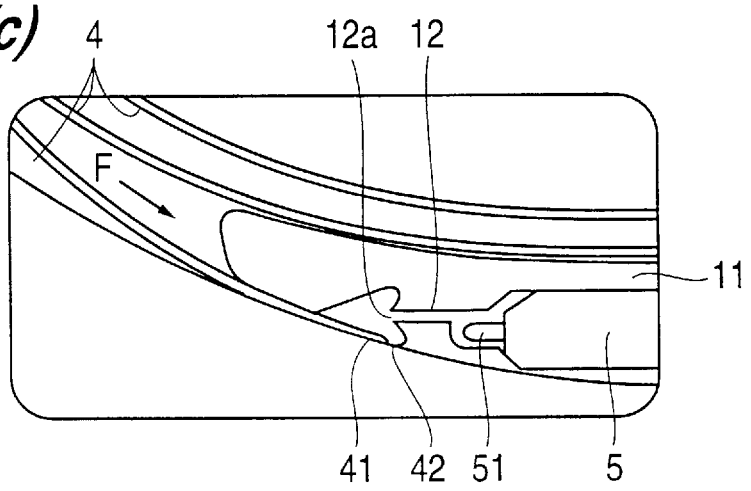
Figure 4A:
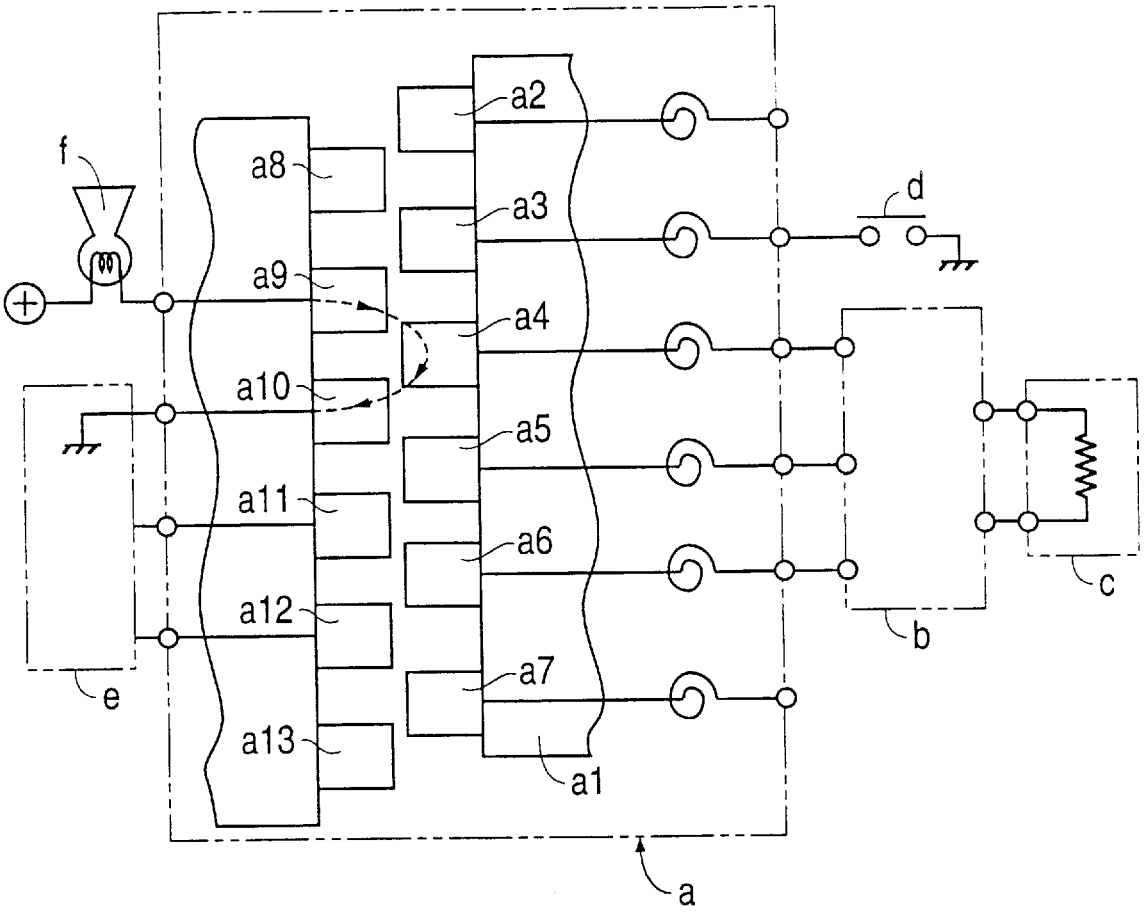
Figure 4B:
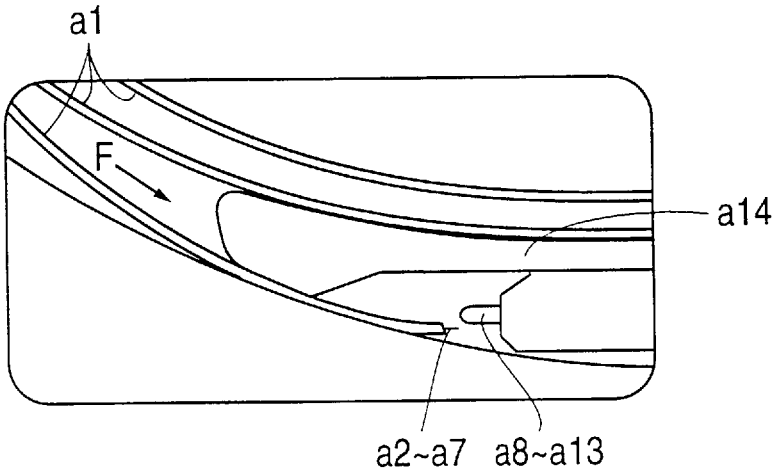

Therefore, when the rotor housing 2 is turned counterclockwise, as shown by an arrow E in FIG. 2*b*, the flexible cable 4 also advances in the same direction along the outer wall of the stator housing 1, as shown by an arrow F in FIGS. 2*b* and 3*b*. Consequently, an end 41 of the flexible cable 4 contacts the inlet surface 12*a* of the passage 12 in the supporter 11, as shown in FIG. 3*c*. However, since the angle of the inlet surface 12*a* is set larger than 180 degrees, the end 41 of the flexible cable 4 is not guided into the passage 12, and the sheath-removed portion of the conductive wire 42 in the broken flexible cable 4 does not contact the terminal 51 again.

Figure 1B:
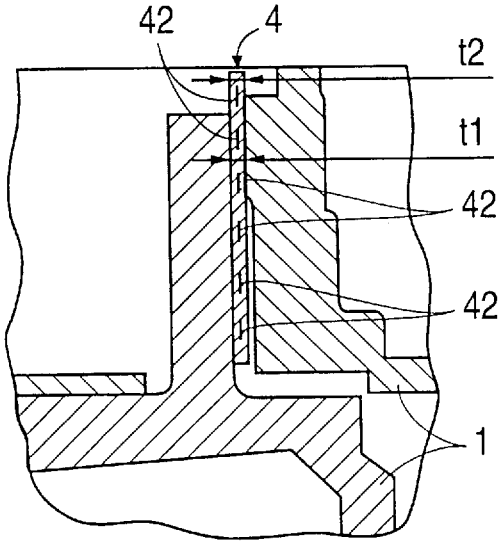

As shown in FIG. 1*b*, the width t1 of a gap constituting the passage 12 is set substantially equal to the thickness t2 of the flexible cable 4. This also serves to prevent the entry of the broken flexible cable 4 into the passage 12, and to retain the flexible cable 4 in a normal condition so as not to allow useless stress to be readily imparted to the portion of the flexible cable 4 that is connected to the terminal 51.

The rotor housing 2 is rotatable with respect to the stator housing 1, and connected to a steering wheel (not shown) by a connecting pin (not shown). The rotor housing 2 is connected to the stator housing 1 by the attachment 3.

The flexible cable 4 in use comprises, for example, a so-called flat cable formed by sandwiching a conductive wire 42 between resin films. Such a flexible cable 4 is held in a doughnut-shaped space defined by the stator housing 1 and rotor housing 2. The flexible cable 4 is electrically connected at one end thereof to the terminal 51 of the stator housing 1, and at the other end thereof to a terminal 6 of the rotor housing 2.

The molded member 5 is a part formed by molding the terminals 51 with a resin 52. The molded member 5 is formed, for example, by setting in an injection molding metal mold a partially assembled product, which is obtained by connecting the sheath-removed portion of the conductive wire 42 extending from an end 41 of the flexible cable 4 to the terminal 51 by welding or fusing; injecting a molten resin into the metal mold;

and then cooling and solidifying the resin. The molded member 5 is supported on the supporter 11, as mentioned above, and has the function of electrically connecting the flexible cable 4 and an electric wire (not shown) on the side of the chassis together. The conductive wire in the flexible cable 4 is connected to the terminals 51 of the molded member 5. The flexible cable 4 is inserted through the passage 12 in the supporter 11, and then drawn into the doughnut-shaped space defined by the two housings 1, 2.

The rotary connector formed as described above is operated as follows.

The rotary connector of the above-described construction is connected at one terminal thereof to, for example, an air bag unit (not shown) on the side of a steering wheel, and at the other terminal 51 thereof to, for example, an air bag controller (not shown) on the side of a chassis. For example, when an automobile collides with something, an electric signal from the air bag controller is transmitted to, for example, the air bag unit on a steering pad through the flexible cable 4 in the rotary connector owing to this arrangement to ignite an inflator, whereby the air bag can be expanded.

The present invention is not limited to the above-described embodiment. The barriers may also be provided on a part other than the supporter. For example, a structure may be employed in which the barriers are provided in a position along the outer wall of the stator housing and in the vicinity of the supporter so as to prevent by the barriers the entry of a broken flexible cable into the inside of the supporter.

In the rotary connector according to the present invention having a stator housing, a rotor housing provided rotatably with respect to the stator housing, and a flexible cable which is held spirally in a space formed by the two housings, and which is connected at one end thereof to the stator housing and at the other end thereof to the rotor housing, with a conductive wire in the flexible cable electrically connected to a terminal which is supported on a supporter provided on at least one of the two housings, various techniques are employed. These techniques include providing on the supporter on at least one of the two housings barriers for preventing the flexible cable which has been broken and left the supporter from entering the inside of the supporter again, providing in the barriers a passage through which the flexible cable is inserted, setting an angle θ made by an inlet surface of the passage larger than 180 degrees, and setting a width t1 of a gap which constitutes the passage substantially equal to a thickness t2 of the flexible cable. Therefore, when the conductive wire in the flexible cable and the terminal are disconnected from each other, so that the broken flexible cable then comes out of the inlet surface, the flexible cable does not enter the passage in the supporter again via the inlet surface for the flexible cable. Thus, an erroneous operation of a load on a vehicle, which would occur when a sheath-removed portion of a conductive wire in the broken flexible cable contacts the terminal again, can be prevented.

It will be appreciated that the present invention is not limited to the exact construction which has been described above and which is illustrated in the accompanying drawings, and that various modifications and changes can be made without departing from the scope thereof. It is intended that the scope of the invention only be limited by the appended claims.

I claim:

1. A rotary connector for supplying a power source current to an electrical component, comprising:

a stator housing;

a rotor housing connected to said stator housing and rotatable with respect to said housing;

a flexible cable held spirally in a space formed by said stator housing and said rotor housing, said cable having a first end connected to said stator housing and a second end connected to said rotor housing;

a supporter provided on at least one of said stator housing and said rotor housing, a terminal being supported on said supporter, and a conductive wire in said flexible cable being electrically connected to said terminal; and a barrier means provided on at least one of said stator housing and said rotor housing for preventing said flexible cable from entering an inside of said supporter after said flexible cable is broken and separated from said supporter;

wherein said barrier means comprises a pair of barriers formed on either side of a passage through which said flexible cable passes into said supporter, said barriers defining an inlet surface facing away from said terminal, said inlet surface having a generally convex shape for guiding said flexible cable away from an opening of said passage.

2. The rotary connector according to claim 1, wherein a width of said passage is set substantially equal to a thickness of said flexible cable.

3. The rotary connector according to claim 1, wherein an angle formed by said inlet surface is larger than 180 degrees.

4. The rotary connector according to claim 1, wherein said barriers are integral with said supporter.

* * * * *